US009057275B2

(12) United States Patent
Chopra et al.

(10) Patent No.: US 9,057,275 B2
(45) Date of Patent: Jun. 16, 2015

(54) NOZZLE DIAPHRAGM INDUCER

(75) Inventors: Sanjay Chopra, Schenectady, NY (US); Michael Joseph Boss, Ballston Spa, NY (US); Tai Joung Kim, Schenectady, NY (US); Jason Paul Mortzheim, Gloversville, NY (US); Nestor Hernandez Sanchez, Schenectady, NY (US); Howard Michael Brilliant, Niskayuna, NY (US)

(73) Assignee: GENEAL ELECTRIC COMPANY, Schenectady, NY (US)

( * ) Notice: Subject to any disclaimer, the term of this patent is extended or adjusted under 35 U.S.C. 154(b) by 567 days.

(21) Appl. No.: 13/487,332

(22) Filed: Jun. 4, 2012

(65) Prior Publication Data

US 2013/0323011 A1 Dec. 5, 2013

(51) Int. Cl.

| | |
|---|---|
| ***F01D 7/00*** | (2006.01) |
| ***F01K 7/16*** | (2006.01) |
| ***F01D 5/08*** | (2006.01) |

(52) U.S. Cl.

CPC ..... *F01D 5/082* (2013.01); *F05D 2220/31* (2013.01); *F05D 2250/314* (2013.01); *F05D 2260/97* (2013.01); *F05D 2260/14* (2013.01)

(58) Field of Classification Search

CPC ..... F01D 5/082; F05D 2220/31; F05D 2250/314; F05D 2260/14; F05D 2260/97

See application file for complete search history.

(56) References Cited

U.S. PATENT DOCUMENTS

| | | | | |
|---|---|---|---|---|
| 3,826,084 | A | 7/1974 | Branstrom et al. | |
| 4,309,873 | A * | 1/1982 | Koran et al. | 60/646 |
| 5,253,976 | A * | 10/1993 | Cunha | 415/114 |
| 5,320,483 | A * | 6/1994 | Cunha et al. | 415/114 |
| 5,340,274 | A * | 8/1994 | Cunha | 415/115 |
| 6,224,327 | B1 * | 5/2001 | Aoki et al. | 415/115 |
| 6,397,604 | B2 * | 6/2002 | Eldrid et al. | 60/782 |
| 6,779,972 | B2 * | 8/2004 | Farrell et al. | 415/174.5 |
| 6,896,482 | B2 * | 5/2005 | Parry | 415/136 |
| 7,003,956 | B2 * | 2/2006 | Yamashita et al. | 60/646 |
| 8,167,535 | B2 | 5/2012 | Parry et al. | |
| 2007/0257445 | A1 | 11/2007 | Mortzheim et al. | |
| 2008/0193283 | A1 | 8/2008 | Burdgick et al. | |
| 2010/0021283 | A1 * | 1/2010 | Parry et al. | 415/116 |
| 2010/0166549 | A1 | 7/2010 | Hatman | |
| 2010/0175378 | A1 | 7/2010 | Tyler et al. | |
| 2011/0085905 | A1 | 4/2011 | Willett et al. | |
| 2011/0097198 | A1 | 4/2011 | Sanchez | |
| 2012/0043728 | A1 | 2/2012 | Zeng et al. | |

FOREIGN PATENT DOCUMENTS

| | | | |
|---|---|---|---|
| DE | 102009026153 | A1 | 1/2010 |
| EP | 2343443 | A2 | 7/2011 |

OTHER PUBLICATIONS

A European Search Report and Opinion issued in connection with corresponding Application No. 13169889.6 on Jul. 29, 2014.

* cited by examiner

*Primary Examiner* — Igor Kershteyn

(74) *Attorney, Agent, or Firm* — Sutherland Asbill & Brennan LLP

(57) ABSTRACT

The present application provides a steam turbine driven by a flow of steam. The steam turbine may include a rotor, a number of nozzles positioned about the rotor, and a number of nozzle diaphragms. One or more of the nozzle diaphragms may include an inducer.

18 Claims, 2 Drawing Sheets

NOZZLE DIAPHRAGM INDUCER

TECHNICAL FIELD

The present application and the resultant patent relate generally to turbo-machinery and more particularly relate to a nozzle diaphragm with and inducer thereon to provide a cooling flow to a rotor of a steam turbine and the like for improved performance and lifetime.

BACKGROUND OF THE INVENTION

An increase in steam turbine inlet temperatures provides improved overall efficiency with a reduce fuel cost and carbon footprint. Steam turbines thus must be able to withstand such higher steam temperatures without compromising the useful life of the rotor and other components. Materials that are more temperature resistant may be used in the construction of the rotor, but such materials may substantially increase the cost of the rotor components. High pressure, lower temperature steam also may be used as a coolant for the rotor, but the use of such a cooling flow also may increase the costs of the rotor while also degrading overall rotor performance. Moreover, there are parasitic costs involved in using downstream cooling flows.

There is thus a desire for an improved turbo-machine such as a steam turbine and the like that can adequately and efficiently cool the rotor and other components for an improved lifetime but with limited parasitic losses for improved performance.

SUMMARY OF THE INVENTION

The present application and the resultant patent thus provide a steam turbine driven by a flow of steam. The steam turbine may include a rotor, a number of nozzles positioned about the rotor, and with each of the nozzles including a nozzle diaphragm. One or more of the nozzle diaphragms may include an inducer plate to direct an impingement flow to the rotor.

The present application and the resultant patent further provide a method of operating a steam turbine. The method may include the steps of rotating a number of buckets positioned on a rotor, forcing a flow of steam through a flow path between the buckets and a number of nozzles, directing a portion of the flow of steam through an inducer plate positioned about one or more of the nozzles, and directing the portion of the flow towards the rotor with an angled configuration.

The present application and the resultant patent further provide a steam turbine stage driven by a flow of steam. The steam turbine stage may include a rotor, a number of buckets positioned on the rotor, a number of nozzles positioned about the rotor, and with each of the nozzles including a nozzle diaphragm. The nozzle diaphragm may include an inducer plate to direct an impingement flow to the rotor in an angled configuration.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
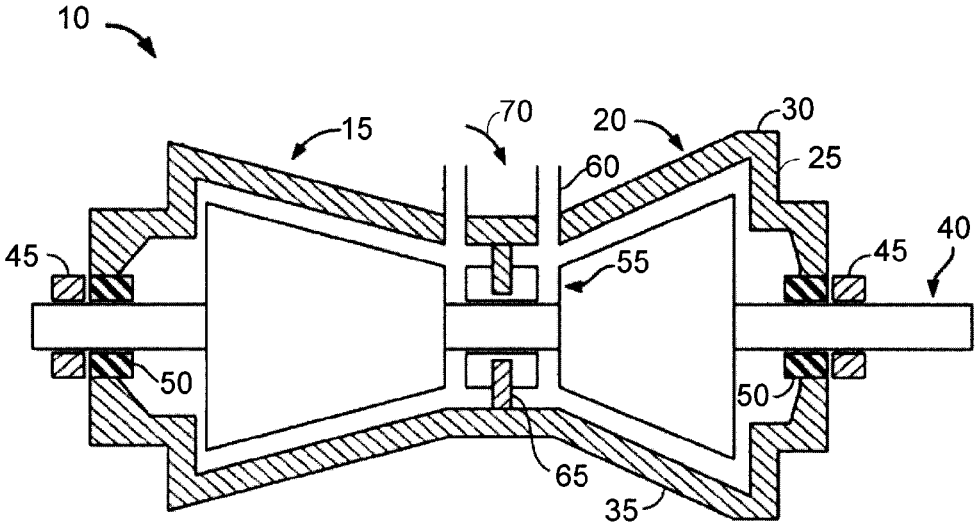
FIG. 1 is a schematic diagram of an example of a steam turbine with a number of sections.

Referring now to the drawings, in which like numerals refer to like elements throughout the several views, FIG. 1 is a schematic diagram of an example of a steam turbine 10. The steam turbine 10 may include a first section 15 and a second section 20. The sections 15, 20 may be high pressure sections, intermediate pressure sections, and/or low pressure sections. As will be described in more detail below, each of the sections 15, 20 may have a number of stages therein. An outer shell or casing 25 may be divided axially into upper and lower half sections 30, 35, respectively. A rotor 40 may extend through the casing 25 and may be supported by a number of journal bearings 45. A number of seals 50 also may surround the rotor 40 about the ends and elsewhere. A central section 55 may include one or more steam inlets 60. A flow splitter 65 may extend between the sections 15, 20 so as to split an incoming flow of steam 70 therethrough.

Figure 2:
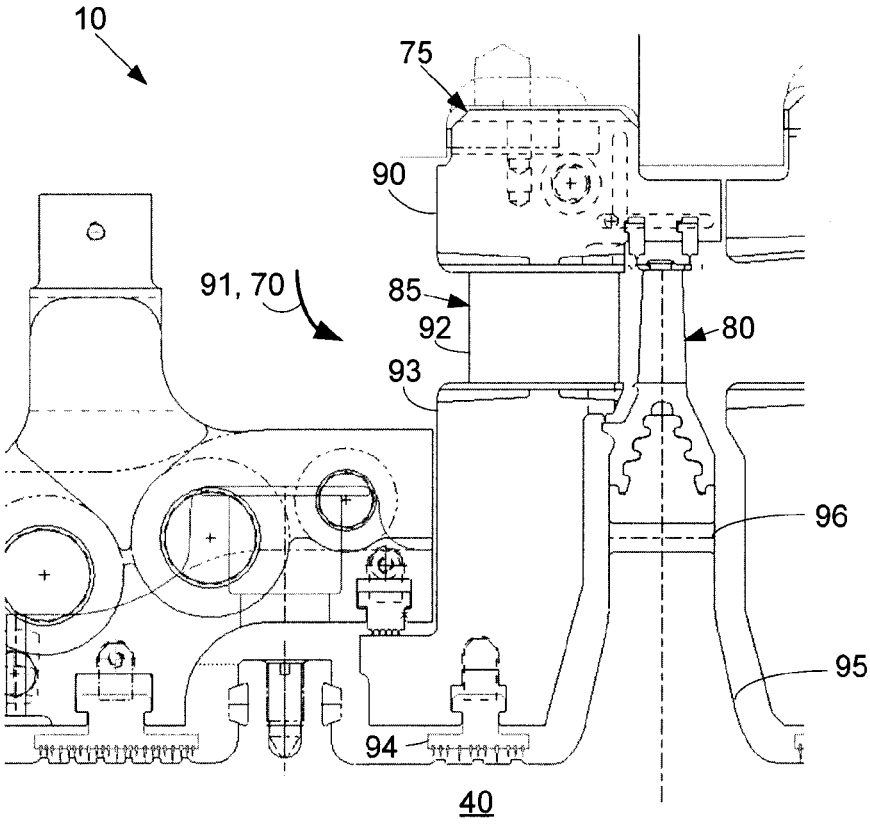
FIG. 2 is a partial side view of a stage of the steam turbine of FIG. 1 with a bucket and a nozzle.

FIG. 2 shows an example of a stage 75 that may be used with the steam turbine 10. Generally described, each stage 75 may include a number of buckets 80 arranged circumferentially about the rotor 40. Likewise, a number of stationary nozzles 85 may be circumferentially arranged about a stator 90. The buckets 80 and the nozzles 85 define a flow path 91 therebetween for the flow of steam 70 so as to urge rotation of the rotor 40. Each bucket 80 may include an airfoil 92 extending from the stator 90 into the flow path 91. A nozzle diaphragm 93 may extend from the airfoil 92 towards the rotor 40. A labyrinth seal 94 may extend from the nozzle diaphragm 93 towards the rotor 40 so as to limit leakage therethrough.

In use, the flow of steam 70 passes through the steam inlets 60 and into the sections 15, 20 such that mechanical work may be extracted from the steam by the stages 75 therein so as to rotate the rotor 40. The flow of steam 70 then may exit the sections 15, 20 for further processing and the like. The steam turbine 10 described herein is for the purpose of example only. Steam turbines and/or other types of turbo-machinery in many other configurations and with many other or different components also may be used herein.

As described above, efficient operation and adequate component lifetime in a steam turbine 10 requires cooling the rotor 40. Known methods for cooling the rotor 40 may include external cooling sources. Other techniques may involve the use of a reverse flow of steam to cool the rotor 40. For example, the buckets 80 may be attached to the rotor 40 via a rotor wheel 95. The rotor wheel 95 may have one or more cooling holes 96 extending therethrough for a reverse cooling flow. This negative root reaction concept, however, may have an impact on overall efficiency.

Figure 3:
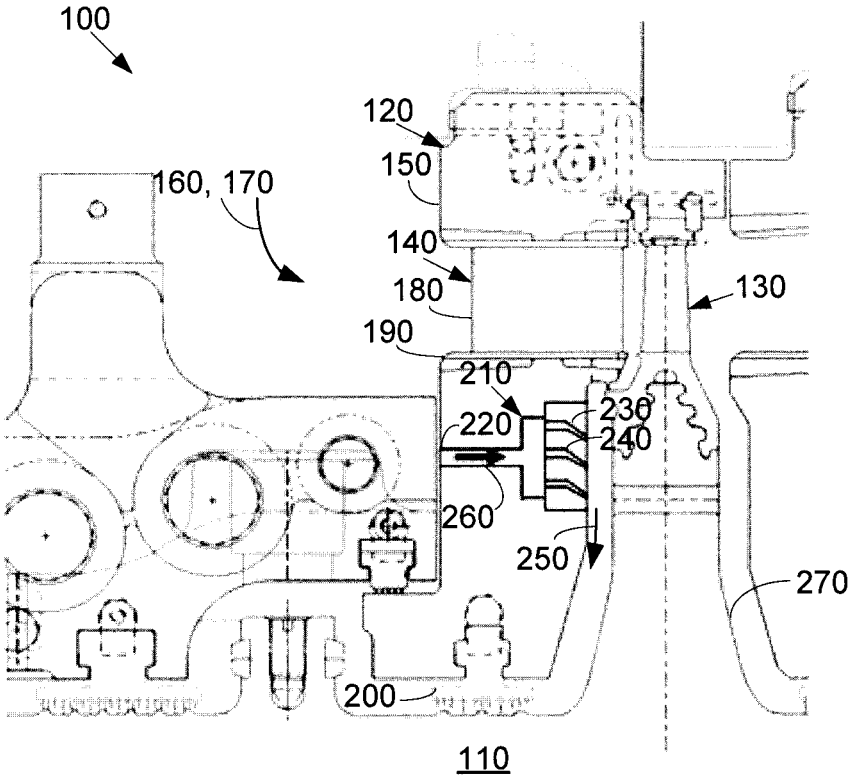
FIG. 3 is a partial side view of a stage of a steam turbine as may be described herein with a bucket and a nozzle.

FIG. 3 shows a portion of steam turbine 100 as may be described herein. The steam turbine 100 may include a rotor 110 extending therethrough. A number of stages 120 may be positioned about the rotor 110. Any number of stages 120 may be used herein. Each stage 120 may include a number of buckets 130 arranged circumferentially about the rotor 110 for rotation therewith. The buckets 130 may be attached to a rotor wheel 135 and the like. Likewise, each stage 120 may include a number of stationary nozzles 140 arranged circumferentially about a stator 150. The buckets 130 and the nozzles 140 may define a flow path 160 for a flow of steam 170 so as to urge rotation of the rotor 110. The buckets 130 and the nozzles 140 may have any size, shape, or configuration. Other components and other configurations may be used herein.

Each of the nozzles 140 may include an airfoil 180 extending from the stator 150 into the flow path 160. A nozzle diaphragm 190 may extend from the airfoil 180 towards the rotor 110. The nozzle diaphragm 190 may have any size, shape, or configuration. A labyrinth seal 200 and the like may extend from the nozzle diaphragm 190 towards the rotor 110 so as to limit leakage along the rotor 110. Other types of rotor seals may be used herein. Other components and other configurations also may be used herein.

The nozzle diaphragm 190 may include an inducer plate 210 positioned therein. The inducer plate 210 may include an air inlet 220. The air inlet 220 may lead to one or more outlet jets 230. Any number of the outlet jets 230 may be in communication with each air inlet 220. The outlet jets 230 may have an angled configuration 240. The angled configuration 240 may be directed towards the rotor 110 and the rotor wheel 270. The spacing of the outlet jets 230 with the angled configuration 240 may be varied and may be optimized. The inducer plate 210 and the components thereof may have any size, shape, or configuration. Any number of the inducer plates 210 may be used herein. The outlet jets 230 with the angled configuration 240 may be optimize to provide a high velocity impingement flow 250 towards the rotor 110 from a portion 260 of the flow of steam 170. The impingement flow 250 may have a reduced temperature, particularly about the rotor wheel 270, so as to ensure adequate rotor cooling. Other components and other configurations may be used herein.

The inducer plate 210 thus imparts a tangential component to the velocity of the impingement flow 250. The tangential velocity or "pre-swirl" may reduce the temperature of the steam relative to the rotor 110. This pre-swirl also may reduce windage about the rotor 110 by reducing the amount of work that the rotor 110 may perform on the flow. As a result, overall rotor component lifetime may be improved. The inducer plate 210 may be modular and may be original equipment or part of a retrofit.

The inducer plate 210 thus may increase the aerodynamic stage efficiency by eliminating the current negative root reaction approach to cooling. Likewise, eliminating external cooling sources may result in improved performance and a reduced carbon footprint. The overall parasitic flow rate in terms of leakage and the external flow rate may be reduced. The inducer plate 210 thus may improve overall operation with an increased rotor lifetime.

The inducer plate 210 may be used with existing cooling techniques and/or may replace such existing techniques in whole or in part. Inducer plates 210 with varying sizes, shapes, and configurations may be used herein together. Nozzle diaphragms 190 without the inducer plate 210 may be used with nozzle diaphragms 190 having the inducer plate 210 therein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A steam turbine driven by a flow of steam, comprising:
a rotor wheel with a cooling hole extending therethrough;
a plurality of nozzles positioned about the rotor;
each of the plurality of nozzles comprising a nozzle diaphragm; and
wherein one or more of the nozzle diaphragms comprises an inducer plate positioned therein and configured to direct an impingement flow to the rotor, the inducer plate comprising:
an air inlet configured to receive a portion of the flow of steam, the air inlet aligned axially with the rotor wheel and positioned radially outward with respect to the cooling hole of the rotor wheel; and
one or more outlet jets configured to redirect the impingement flow from the air inlet to a tangential flow path exiting the one or more outlet jets.

2. The steam turbine of claim 1, wherein the one or more outlet jets comprise an angled configuration.

3. The steam turbine of claim 2, wherein the a rotor wheel is mounted on a rotor and wherein the angled configuration directs the impingement flow towards the rotor wheel.

4. The stream turbine of claim 3, further comprising a plurality of buckets attached to the rotor.

5. The steam turbine of claim 4, wherein the plurality of nozzles and the plurality of buckets comprise a flow path therethrough.

6. The steam turbine of claim 4, wherein the plurality of nozzles and the plurality of buckets comprise a stage of the steam turbine.

7. The steam turbine of claim 1, wherein each of the plurality of nozzles comprises an airfoil positioned between a stator and a nozzle diaphragm.

8. The steam turbine of claim 1, wherein the each of the plurality of nozzles comprises a labyrinth seal thereon.

9. The stream turbine of claim 1, wherein the inducer plate comprises original equipment.

10. The steam turbine of claim 1, wherein the inducer plate comprises a retro-fit.

11. A method of operating a steam turbine, comprising:
rotating a plurality of buckets positioned on a rotor via a plurality of rotor wheels, each of the plurality of rotor wheels comprising a cooling hole extending therethrough;
forcing a flow of steam through a flow path between the plurality of buckets and a plurality of nozzles;
directing a portion of the flow of steam through an inducer plate positioned about one or more of the plurality of nozzles, wherein the inducer plate comprises an air inlet that is positioned radially outward with respect to the cooling hole of the respective rotor wheel; and
directing the portion of the flow towards the rotor with an angled configuration.

12. The method of claim 11, further comprising the step of positioning the inducer plate within a nozzle diaphragm of the one or more of the plurality of nozzles.

13. The method of claim 11, wherein the portion of the flow comprises an impingement flow.

14. A steam turbine stage driven by a flow of steam, comprising:
a rotor;
a plurality of buckets positioned on the rotor with a plurality of rotor wheels, each of the plurality of rotor wheels comprising a cooling hole extending therethrough;
a plurality of nozzles positioned about the rotor;
each of the plurality of nozzles comprising a nozzle diaphragm; and
wherein the nozzle diaphragm comprises an inducer plate to direct an impingement flow to the rotor in an angled configuration, the inducer plate comprising an air inlet configured to receive a flow of steam, the air inlet aligned axially with the rotor wheel and positioned radially outward with respect to the cooling hole of the respective rotor wheel.

15. The steam turbine stage of claim 14, wherein the inducer plate comprises one or more outlet jets.

16. The steam turbine stage of claim 14, wherein the angled configuration directs the impingement flow towards the rotor wheel.

17. The stream turbine stage of claim 14, wherein the angled configuration imparts a tangential component to the impingement flow.

18. The steam turbine of claim 14, wherein the plurality of nozzles and the plurality of buckets comprise a flow path therethrough.

* * * * *